US009687122B2

(12) United States Patent
Harris

(10) Patent No.: US 9,687,122 B2
(45) Date of Patent: Jun. 27, 2017

(54) MINI PUMP WITH COMPRESSIBLE AIR INLET CHAMBER FOR PROVIDING RESIDUAL SUCK-BACK

(71) Applicant: GOJO Industries, Inc., Akron, OH (US)

(72) Inventor: Donald R. Harris, Tallmadge, OH (US)

(73) Assignee: GOJO Industries, Inc., Akron, OH (US)

( * ) Notice: Subject to any disclaimer, the term of this patent is extended or adjusted under 35 U.S.C. 154(b) by 64 days.

(21) Appl. No.: 14/688,474

(22) Filed: Apr. 16, 2015

(65) Prior Publication Data

US 2015/0297039 A1 Oct. 22, 2015

Related U.S. Application Data

(60) Provisional application No. 61/980,235, filed on Apr. 16, 2014.

(51) Int. Cl.
*A47K 5/16* (2006.01)
*F04B 53/14* (2006.01)
(Continued)

(52) U.S. Cl.
CPC ..... *A47K 5/16* (2013.01); *A47K 5/14* (2013.01); *B05B 7/0018* (2013.01);
(Continued)

(58) Field of Classification Search
CPC ..... A47K 5/16; A47K 5/14; B05B 7/0018; B05B 11/3001; B05B 11/3087; B05B 11/3097; B05B 7/0037; B67D 7/741; F04B 23/02; F04B 53/10; F04B 53/14; F04B 53/16; B05C 17/00553
See application file for complete search history.

(56) References Cited

U.S. PATENT DOCUMENTS 5,439,140 A * 8/1995 Meyer ..... A45D 27/10 222/110
5,862,954 A * 1/1999 Ehrensperger ..... A45D 27/10 222/190

(Continued)

FOREIGN PATENT DOCUMENTS

WO 2013022634 A2 2/2013

*Primary Examiner* — Frederick C Nicolas
(74) *Attorney, Agent, or Firm* — Calfee, Halter & Griswold LLP

(57) ABSTRACT

Exemplary dispensers, pumps and refill units are disclosed herein. An exemplary refill unit includes a container and a foam pump. The foam pump includes a liquid pump chamber, a compressible air inlet chamber and a compressed air inlet. The volume of the compressible air inlet chamber is less than the volume of air used to make a dose of foam. A one-way air inlet valve is located proximate the compressed air inlet. A piston is included that is movable within the liquid pump chamber and has a liquid seal member and an air seal member. The liquid pump chamber includes a liquid outlet into a center portion of the piston. One or more openings extend through the piston wall and provide a passage from the compressible air chamber to the center portion of the piston. The pump further includes mix media and an outlet.

20 Claims, 2 Drawing Sheets

(51) Int. Cl.

| | |
|---|---|
| ***F04B 53/16*** | (2006.01) |
| ***B05C 17/005*** | (2006.01) |
| ***F04B 23/02*** | (2006.01) |
| ***F04B 53/10*** | (2006.01) |
| ***B67D 7/74*** | (2010.01) |
| ***A47K 5/14*** | (2006.01) |
| ***B05B 11/00*** | (2006.01) |
| *B05B 7/00* | (2006.01) |

(52) U.S. Cl.

CPC ..... *B05B 11/3001* (2013.01); *B05B 11/3087* (2013.01); *B05B 11/3097* (2013.01); *B05C 17/00553* (2013.01); *B67D 7/741* (2013.01); *F04B 23/02* (2013.01); *F04B 53/10* (2013.01); *F04B 53/14* (2013.01); *F04B 53/16* (2013.01); *B05B 7/0037* (2013.01)

(56) References Cited

U.S. PATENT DOCUMENTS

| | | | | |
|---|---|---|---|---|
| 6,626,332 | B2 * | 9/2003 | Ehrensperger | A47K 5/14 222/1 |
| 7,431,182 | B2 | 10/2008 | Ciavarella | |
| 8,360,287 | B2 * | 1/2013 | Ciavarella | A47K 5/1208 222/209 |
| 8,499,981 | B2 * | 8/2013 | Quinlan | A47K 5/14 222/136 |
| 8,505,776 | B2 | 8/2013 | Criswell et al. | |
| 8,827,119 | B2 * | 9/2014 | Ciavarella | B65D 83/00 222/181.1 |
| 9,392,913 | B2 * | 7/2016 | Quinlan | A47K 5/16 |
| 2013/0299518 | A1 | 11/2013 | McNulty et al. | |
| 2014/0319180 | A1 * | 10/2014 | Quinlan | A47K 5/16 222/190 |

* cited by examiner

MINI PUMP WITH COMPRESSIBLE AIR INLET CHAMBER FOR PROVIDING RESIDUAL SUCK-BACK

RELATED APPLICATIONS

This non-provisional utility patent application claims priority to and the benefits of U.S. Provisional Patent Application No. 61/980,235 filed on Apr. 16, 2014 and entitled MINI PUMP WITH COMPRESSIBLE AIR INLET CHAMBER FOR PROVIDING RESIDUAL SUCK-BACK, which is incorporated herein by reference in its entirety.

TECHNICAL FIELD

The present invention relates generally to pumps, refill units for dispensers and dispenser systems, and more particularly to inverted liquid and foam pumps having a compressible air inlet chamber for providing residual suck back, as well as a disposable refill/replacement unit including such pumps.

BACKGROUND OF THE INVENTION

Liquid dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles. As a general matter, it is usually preferable to reduce the space taken up by the pumping and foaming apparatus within the overall dispenser system. This maximizes the available space for storing the liquid, and has other benefits. After dispensing a dose of foam, some of the residual foam remains in the outlet nozzle of the pump. In many inverted foam dispensers the residual foam turns into a liquid and drips out of the outlet nozzle creating a mess under the dispenser.

SUMMARY

Exemplary dispensers, pumps and refill units are disclosed herein. An exemplary refill unit includes a container. The container includes a neck. A foam pump is secured to the neck. The foam pump includes a liquid pump chamber, a compressible air inlet chamber and a compressed air inlet that receives compressed air having an air pressure of greater than ambient air pressure. The volume of the compressible air inlet chamber is less than the volume of air used to make a dose of foam. A one-way air inlet valve is located proximate the compressed air inlet. A piston is included that is movable within the liquid pump chamber. The piston has a liquid seal member for providing a movable seal against a wall of the liquid pump chamber and an air seal member for providing a movable seal against a wall of the compressible air inlet chamber. The liquid pump chamber includes a liquid outlet into a center portion of the piston. One or more openings extend through the piston wall and provide a passage from the compressible air inlet chamber to the center portion of the piston. One or more foaming elements are located within the piston and an outlet is located at the distal end of the piston.

Another exemplary refill unit includes a container. The container has a neck located at the bottom of the container. A foam pump is secured to the neck. The foam pump has a liquid pump chamber, a compressed air inlet, a compressible air inlet chamber located downstream of the compressed air inlet, a mixing chamber and one or more mixing elements located downstream of the mixing chamber. When the volume of the liquid pump chamber is reduced, liquid flows into the mixing chamber and compressed air flows in through the compressed air inlet, through the compressible air inlet chamber and into the mixing chamber to mix with liquid flowing out of the liquid pump chamber. The mixture of liquid and compressed air flow through the one or more mixing elements and is dispensed as a foam. When the volume of the liquid pump chamber is increased, the volume of the compressible air inlet chamber increases and draws residual foam and/or liquid up toward the compressible air inlet chamber.

Another exemplary refill unit includes a container having a neck and a foam pump. The foam pump includes a piston, a liquid pump chamber, a compressible air inlet chamber and a compressed air inlet that receives compressed air having an air pressure of greater than ambient air pressure. A one-way air inlet valve proximate the air inlet for allowing air to flow into the compressible air inlet chamber and preventing fluid from flowing out of the compressed air inlet is also included. A piston is movable within the liquid pump chamber and the compressible air inlet chamber. The piston has a liquid seal member for sealing against a wall of the liquid pump chamber and an air seal member for sealing against a wall of the compressible air inlet chamber. The liquid pump chamber has a liquid outlet into a center of the piston. One or more openings extend through the piston wall providing a passage from the compressible air chamber to a mixing chamber in the center of the piston. One or more foaming elements are located at least partially within the piston; and an outlet located at the distal end of the piston.

BRIEF DESCRIPTION OF THE DRAWINGS

These and other features and advantages of the present invention will become better understood with regard to the following description and accompanying drawings in which.

DETAILED DESCRIPTION

Figure 1:
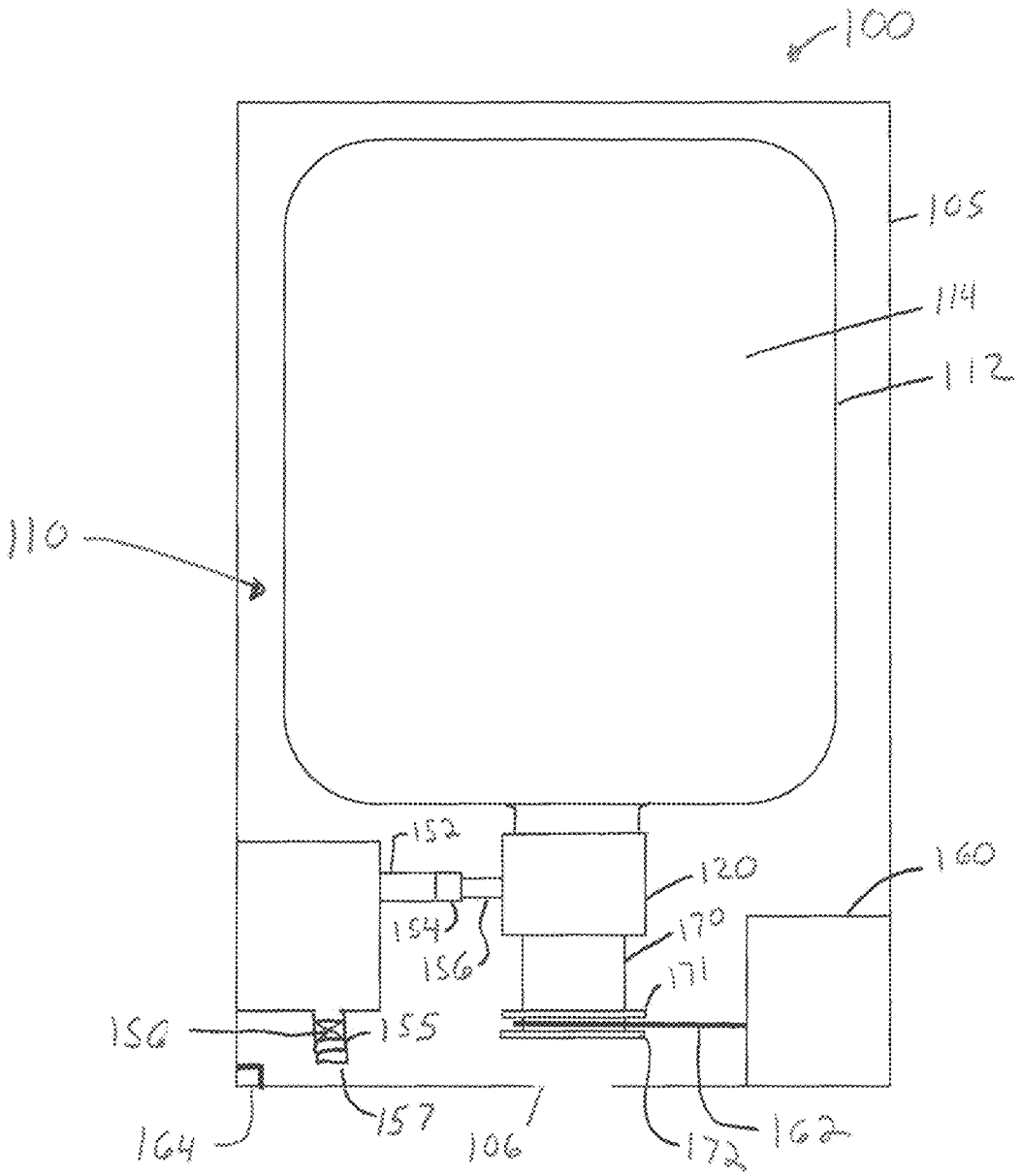
FIG. 1 illustrates a dispenser 100 having a air compressor attached thereto and a refill unit that includes a container, a liquid pump and an air inlet that is releasably connectable to the air compressor.

FIG. 1 illustrates an exemplary embodiment of a foam dispensing system 100. Foam dispensing system 100 includes a disposable refill unit 110 for use in a foam dispenser 105. The disposable refill unit 110 includes a container 112 connected to a pump 120. Pump 120 includes a compressed air inlet 156. The disposable refill unit 110 may be placed within a housing of the dispenser 105 and the compressed air inlet 156 releasably placed in fluid communication with air compressor 150.

The foam dispenser system 100 may be a wall-mounted system, a counter-mounted system, an un-mounted portable system movable from place to place or any other kind of foam dispenser system. Foam dispenser 105 includes an air compressor 150 permanently mounted to foam dispenser 105. Air compressor 150 includes an air conduit 152 with a connector 154 for releasably connecting to the compressed air inlet 156 of pump 120. Optionally, connector 154 may be secured to the compressed air inlet 156 pump 120. In one embodiment, connector 154 is a two-part connector, and one part is connected to pump 120 and the other to air conduit 152. Accordingly, refill unit 110 and pump 120 may be removed from dispenser housing 105 and discarded without removal of the air compressor 150. Connector 154 may be a quick release connector, a releasable snap-fit connector, a releasable compression-fit connector or a sealing member such as, for example, a foam member that compresses to form a seal between air conduit 152 and compressed air inlet 156 of pump 120.

The container 112 forms a liquid reservoir 114. The liquid reservoir 114 contains a supply of a foamable liquid within the disposable refill unit 110 and the dispenser housing 105 which holds the refill unit 110. In various embodiments, the contained liquid could be for example a soap, a sanitizer, a cleanser, a disinfectant or some other foamable liquid. In the exemplary disposable refill unit 110, the liquid reservoir 114 is formed by a collapsible container 112, such as a flexible bag-like container. In other embodiments, the liquid reservoir 114 may be formed by a rigid housing member, or have any other suitable configuration for containing the foamable liquid without leaking. If the container 112 is not collapsible, a vent (not shown) may be included to alleviate vacuum pressure from building up in container 112. The container 112 may advantageously be refillable, replaceable or both refillable and replaceable. In other embodiments, the container 112 may be neither refillable nor replaceable.

In the event the liquid stored in the reservoir 114 of the installed disposable refill unit 110 runs out, or the installed refill unit 110 otherwise has a failure, the installed refill unit 110 may be removed from the foam dispenser system 100. The empty or failed disposable refill unit 110 may then be replaced with a new disposable refill unit 110 including a liquid-filled reservoir 114. The air pump 150 remains located within the foam dispenser system 100 while the disposable refill unit 110 is replaced. In one embodiment, the air pump 150 is also removable from the housing of the dispenser system, separately from the disposable refill unit 110, so that the air pump 150 may be replaced without replacing the dispenser 105, or alternatively to facilitate removal and connection to the refill unit 110. Sanitary sealing isolates the air pump 150 from the portions of the foam pump 120 that contact liquid so that the air pump mechanism does not contact liquid during operation of the foam pump 120. Sanitary sealing may be achieved with a one-way valve as described in more detail below.

The housing of the dispensing system 100 further contains an actuator 160 to activate the foam pump 120. Actuator 160 is connected to foam pump 120 by linkage 162. Actuator 160 and linkage 162 are generically shown as it will be appreciated by one of ordinary skill in the art, there are many different kinds of pump actuators, linkages and gearing which may be employed in the foam dispenser system 100. The pump actuator of the foam dispenser system may have any type of actuator, such as, for example, a manual lever, a manual pull bar, a manual push bar, a manual rotatable crank, an electrically activated actuator or other means for actuating the foam pump 120 within the foam dispenser system 100. Electronic pump actuators may additionally include a motion detector 164 to provide for a hands-free dispenser system with touchless operation. Various intermediate linkages 162 connect actuator 160 to the foam pump 120 within the dispenser housing 105, the linkages may include gears, racks, pinions and the like. The exemplary foam pump 120 is a "push-activated" pump. That is, the pump 120 dispenses foam by pushing a nozzle upward. The external actuator may be operated in any manner, so long as the intermediate linkages transform that motion to an upward force on the nozzle 170. In some embodiments, foam pump 120 includes a spring to return nozzle 170 to its downward position. In some embodiments, actuator 160 moves the nozzle 170 to its downward most position. Nozzle 170 includes annular protrusions 171, 172 for engaging with linkage 162 to move nozzle 170. In addition, nozzle 170 has an outlet 175 for dispensing foam, and dispenser housing 105 includes an opening 106 that allows foam to be dispensed to a user.

Air pump 150 includes an air inlet 155 having a one-way air inlet valve 156. One-way air inlet valve 156 allows air to enter air pump 150 to recharge the air pump 150. In some embodiments, the air inlet 155 is located inside of housing 105 so that air from inside of the dispenser housing 105 is used to feed the air pump 150. Using air from inside the housing 105 may help prevent moisture from entering air pump 150 through air inlet 155 and air inlet valve 156. In some embodiments, a vapor barrier 157 is provided. Vapor barrier 157 allows air to pass through and the air inlet and enter the air pump 150, but prevents moisture from entering air pump 150. A suitable vapor barrier is a woven one-way vapor barrier, such as, for example, Gortex®, that is arranged so that vapor does not enter air pump 150. Preventing moisture from entering air pump 150 may prevent mold and bacteria from growing inside the air pump and contaminating the dispensed foam. The term "air pump" and "air compressor" may be used interchangeably herein and have the same meaning, namely a device for providing compressed air at a pressure that is higher than the ambient air pressure.

In one embodiment, air pump 150 includes an anti-microbial substance molded into the air pump housing. One suitable anti-microbial substance contains silver ions and or copper ions. A silver refractory, such as, for example, a glass, oxide, silver phosphate may be used. One suitable commercially available product is Ultra-Fresh, SA-18, available from Thomson Research Associates, Inc. The anti-microbial substance prevents mold or bacteria from growing inside of the air pump 150.

Figure 2:
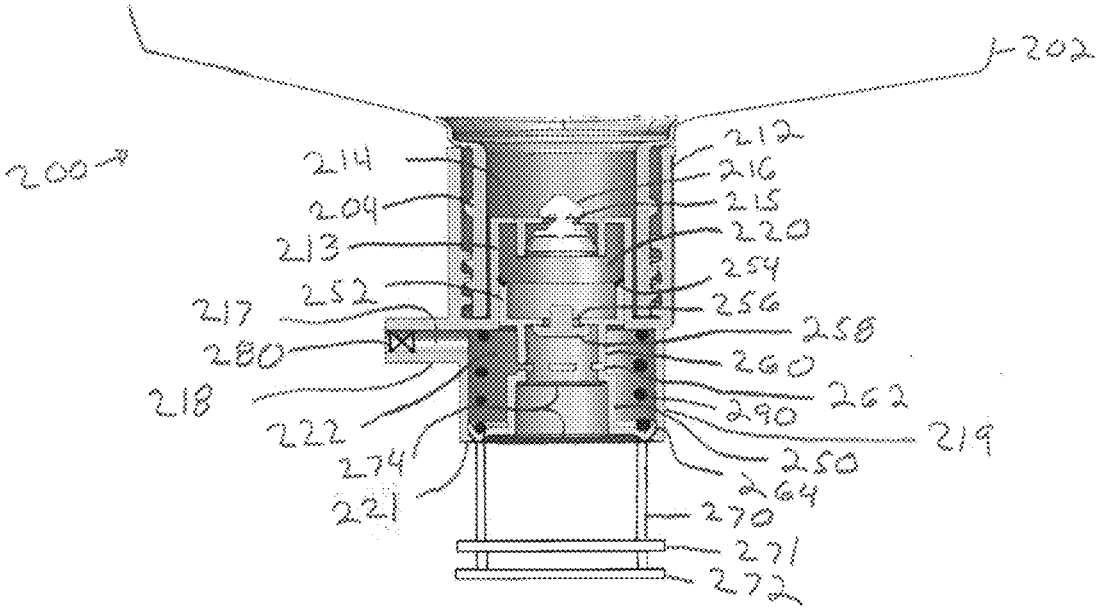
FIG. 2 illustrates a refill unit 200 showing a portion of a container 202 for holding a fluid and a pump 210 in a primed or priming position in accordance with one embodiment.
Figure 3:
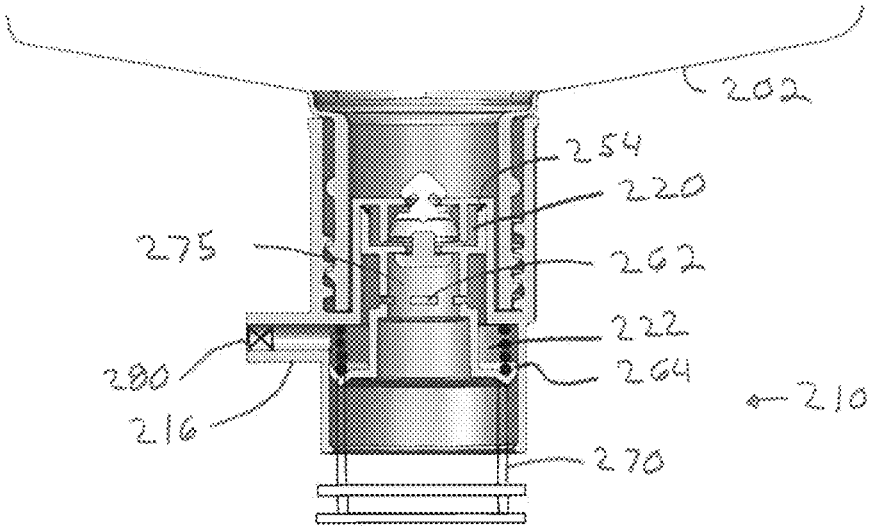
FIG. 3 illustrates the refill unit 200 showing a portion of a container 202 for holding a fluid and a pump 210 in a dispensed or dispensing position.

FIGS. 2 and 3 are partial cross-sections of an exemplary embodiment of a refill unit 200 that includes pump 210 and container 202 for use in the exemplary foam dispensing system 100. Container 202 includes a neck 204. Pump 210 includes a housing 211. Housing 211 includes a collar 212. Collar 212 secures pump 210 to the neck 204 of container 202. Collar 212 may be secured to neck 204 by any means, such as, for example, a threaded connection as shown, a snap-fit connection, an adhesive connection, a welded connection or the like. Pump housing 211 includes a cylindrical wall 213 that extends at least partially up into neck 204. An upper wall 214 is located at the upper end of cylindrical wall 213. One or more liquid apertures 215 are located in upper wall 214 and a one-way liquid inlet valve 216 is located proximate the one or more liquid inlet apertures 215. One-way liquid inlet valve 216 allows liquid to flow into a pump chamber 220 that is formed in part by cylindrical wall 213 and upper wall 214. One-way liquid inlet valve 216 may be any type of valve that allows liquid to flow into pump chamber 220 and prevents liquid from flowing out of pump chamber 220 back into container 202.

Pump housing 211 includes a lower cylindrical wall 219. A compressed air inlet opening 217 is located through cylindrical wall 219. An air inlet conduit 218 surrounds the air inlet opening 217. A one-way air inlet valve 280 is located in air inlet conduit 218. One-way air inlet valve 280 prevents fluid from flowing from the pump 210 back toward a compressed air source (not shown), such as the air pump 150 shown in FIG. 1. Pump housing 211 also includes a piston stop 221 that retains a piston 250 in pump housing 211.

Piston 250 includes an upper portion 252 that forms part of the liquid pump chamber and includes a cylindrical wiper seal 254 that engages with cylindrical wall 213. Wiper seal 254 may be made of the same material as piston 250 or of a different material. One or more liquid outlet openings 256 are located in the floor of the upper portion 252. A one-way liquid outlet valve 258 is located proximate the one or more liquid outlet openings 256. The one-way outlet valve 256 and liquid outlet openings 256 allow liquid to flow out of the liquid pump chamber 220 and into mixing chamber 275 located in the center of piston 250.

Piston 250 also includes a lower portion 260. Lower portion 260 has a cylindrical wall that includes a plurality of openings 262 providing a path from a compressible air inlet chamber 222 located on the exterior of lower portion 260 into the mixing chamber 275. Piston 250 also includes mix media or foaming elements, such as, for example, screens 274 located downstream of the mixing chamber to create turbulence in the mixing of air and foamable liquid. Piston 250 includes a nozzle portion 270 having annular projections 271, 272 for engaging with an actuator of a dispenser.

An air wiper seal 264 that engages with cylindrical wall 219 to form the compressible air inlet chamber 222 is also provided on piston 250. In some embodiments, the air wiper seal 264 is made of the same material as piston 250 and in some embodiments is made of a different material and secured to piston 250.

A biasing member 290, such as, for example, a spring, biases the piston toward its downward most position shown in FIG. 2, with piston stop 219 preventing the piston 250 from further downward movement. In some embodiments, biasing member 290 is not used and the actuator (not shown) moves the nozzle 270 in both the upward dispensing direction and downward priming direction.

FIG. 2 illustrates the pump 210 in a primed position ready to dispense a dose of foam. During operation, nozzle 270, and accordingly, piston 250 is pushed upward to dispense foam. As piston 250 moves upward, liquid wiper seal 254 engages cylindrical wall 213 and the volume of liquid pump chamber 220 is compressed pushing liquid into mixing chamber 275. The lower portion 260 of piston 250 also moves upward. As it does so, air wiper seal 264 moves along cylindrical wall 219 and the volume of compressible air chamber 222 is compressed pushing a small amount of air and any residual liquid into the mixing chamber. The volume of the compressible air inlet chamber 222 is less than the volume of air that is required to produce one dispense of foam. Simultaneous to the movement of piston 250 upward, compressed air from an air pump (not shown) is forced past one-way air inlet valve 280 through air conduit 218 through compressible air inlet chamber 222, through openings 262 and into the mixing chamber 275. The liquid and air mix in the mixing chamber 275 and the mixture is forced through mix media 274 and out of nozzle 270 in the form of a foam.

Once a dispense cycle has been completed, shown in FIG. 3, piston 250 is urged back its rest or primed position shown in FIG. 2. As the piston 250 moves back to its rest position liquid is drawn into liquid chamber 220. In addition, residual foam and liquid in the mixing chamber 275, mix media 274 and nozzle 270 are drawn up toward, and in some embodiments into, compressible air inlet chamber 222 as its volume expands. Accordingly, the compressible air inlet chamber 222 sucks back residual fluid and prevents dripping of the foam dispenser after a dispense cycle is completed.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

I claim:

1. A refill unit comprising:

a container;

the container having a neck;

a foam pump secured to the neck;

the foam pump having a liquid pump chamber; a compressible air inlet chamber; and a compressed air inlet that receives compressed air having an air pressure of greater than ambient air pressure;

wherein the volume of the compressible air inlet chamber is less than the volume of air used to make a shot of foam;

a one-way air inlet valve proximate the compressed air inlet;

a piston movable within the liquid pump chamber;

the piston having a liquid seal member for sealing against a wall of the liquid pump chamber and an air seal member for sealing against a wall of the compressible air inlet chamber;

the liquid pump chamber having a liquid outlet into a center portion of the piston;

one or more openings extending through the piston wall providing a passage from the compressible air chamber to the center portion of the piston;

one or more foaming elements located within the piston; and an outlet located at the distal end of the piston.

2. The refill unit of claim 1 wherein movement of the piston upward compresses the liquid chamber and the compressible air inlet chamber.

3. The refill unit of claim 1 wherein the one or more foaming elements comprises a screen.

4. The refill unit of claim 1 wherein the liquid pump chamber is located above the compressible air inlet chamber.

5. The refill unit of claim 1 wherein the piston forms a portion of the compressible air inlet chamber.

6. The refill unit of claim 1 wherein the piston moves up and down within the compressible air inlet chamber.

7. The refill unit of claim 1 further comprising a liquid outlet valve that moves up and down with the piston.

8. The refill unit of claim 1 further comprising a quick release connector on the compressed air inlet for connecting to a source of compressed air.

9. A refill unit comprising:

a container;

the container having a neck located at the bottom of the container;

a foam pump secured to the neck;

the foam pump having a liquid pump chamber; a compressed air inlet for receiving compressed air from a compressed air source and directing the compressed air into a compressible air inlet chamber located downstream of the compressed air inlet; a mixing chamber and one or more mixing elements located downstream of the mixing chamber;

wherein when the volume of the liquid pump chamber is reduced liquid flows into the mixing chamber and compressed air flows in through the compressed air inlet, through the compressible air inlet chamber and into the mixing chamber to mix with liquid flowing out of the liquid pump chamber; and the mixture of liquid and compressed air flow through the one or more mixing elements and is dispensed as a foam; and wherein when the volume of the liquid pump chamber is increased, the volume of the compressible air inlet chamber increases and draws residual foam and/or liquid up toward the compressible air inlet chamber.

10. The refill unit of claim 9 wherein movement of the piston upward compresses the liquid chamber and the compressible air inlet chamber.

11. The refill unit of claim 9 wherein the liquid pump chamber is located above the compressible air inlet chamber.

12. The refill unit of claim 9 wherein the piston forms a portion of the compressible air inlet chamber.

13. The refill unit of claim 9 wherein the piston moves up and down within the compressible air inlet chamber.

14. The refill unit of claim 9 further comprising a liquid outlet valve that moves up and down with the piston.

15. A refill unit comprising:

a container;

the container having a neck;

a foam pump secured to the neck;

the foam pump having a piston;

a liquid pump chamber;

a compressible air inlet chamber; and a compressed air inlet that receives compressed air having an air pressure of greater than ambient air pressure;

a one-way air inlet valve proximate the air inlet for allowing air to flow into the compressible air inlet chamber and preventing fluid from flowing out of the compressed air inlet;

the piston movable within the liquid pump chamber and the compressible air inlet chamber;

the piston having a liquid seal member for sealing against a wall of the liquid pump chamber and an air seal member for sealing against a wall of the compressible air inlet chamber;

the liquid pump chamber having a liquid outlet into a center of the piston;

one or more openings extending through the piston wall providing a passage from the compressible air chamber to a mixing chamber in the center of the piston;

one or more foaming elements located at least partially within the piston; and an outlet located at the distal end of the piston.

16. The refill unit of claim 15 wherein movement of the piston upward compresses the liquid chamber and the compressible air inlet chamber.

17. The refill unit of claim 15 wherein the liquid pump chamber is located above the compressible air inlet chamber.

18. The refill unit of claim 15 wherein the piston forms a portion of the compressible air inlet chamber.

19. The refill unit of claim 15 wherein the piston moves up and down within the compressible air inlet chamber.

20. The refill unit of claim 15 further comprising a liquid outlet valve that moves up and down with the piston.

* * * * *